US005331364A

United States Patent [19]

Borden

[11] Patent Number: 5,331,364

[45] Date of Patent: Jul. 19, 1994

[54] APPARATUS FOR DILUTING AND MIXING CHEMICALS AND AUTOMATICALLY FEEDING THE DILUTED CHEMICALS TO A PHOTOGRAPHIC PROCESSOR ON DEMAND

[75] Inventor: Robert H. Borden, Salt Lake City, Utah

[73] Assignee: Thatcher Chemical Company, Salt Lake City, Utah

[21] Appl. No.: 918,201

[22] Filed: Jul. 20, 1992

[51] Int. Cl.[5] ..... G03D 3/02; G03D 3/04

[52] U.S. Cl. ..... 354/324; 354/328

[58] Field of Search ..... 354/324, 328; 134/64 R, 134/64 P, 122 R, 122 P; 137/512.1, 527, 516.25; 366/336-340

[56] References Cited

U.S. PATENT DOCUMENTS 5,076,705 12/1991 Brickhouse et al. ..... 366/337

5,151,731 9/1992 Yamada et al. ..... 354/324

5,184,164 2/1993 Kose et al. ..... 354/324

*Primary Examiner*—D. Rutledge

*Attorney, Agent, or Firm*—Terry M. Crellin

[57] ABSTRACT

A system is provided for (1) metering an amount of at least one concentrated liquid chemical solution, (2) metering an amount of water, (3) feeding the metered amounts of concentrated chemical solution and water to a static, inline mixing member and (4) delivering a properly diluted working solution from the mixing member directly to a processing machine. The concentrated liquid chemical solutions are stored in respective storage containers, and metering devices associated with the respective storage containers meter controlled amounts of each concentrated chemical solution for delivery to an inline static mixing member. A water metering device delivers a metered amount of water to the inline mixing member, and mixed, diluted working solution is delivered directly to the inline mixing system is delivered directly to the processing machine.

8 Claims, 2 Drawing Sheets

APPARATUS FOR DILUTING AND MIXING CHEMICALS AND AUTOMATICALLY FEEDING THE DILUTED CHEMICALS TO A PHOTOGRAPHIC PROCESSOR ON DEMAND

BACKGROUND OF THE INVENTION

1. Field of the Invention

The present invention relates broadly to a process of metering one or more concentrated chemical solutions with a metered amount of water and statically mixing the components together in an inline, static mixer to produce a diluted working solution which is fed to an automatic film processing machine on demand from such machine. In particular, the present invention relates to such a process in which the concentrated chemical solutions and water are automatically diluted and mixed together to form a relatively small amount of diluted working solution called for by the processing machine, and the proper amount of working solution is then fed to the processing machine in the specific amounts called for by the processing machine, with no intermediate storage of the diluted working solution other than the amount of working solution contained in the flow conduits that deliver the diluted working solution to the processing machine.

2. State of the Art

The present invention as mentioned above relates generally to apparatus and processes for measuring predetermined amounts of concentrated chemical solution and mixing the concentrated chemical solutions with a measured amount of water in an inline, static mixing device to produce a diluted solution which is delivered directly to an automatic film processing machine upon demand of the processing machine. In typical, automatic processing machines, such as used in processing photographic film in the fields of radiology, lithography and microfilm, the film negatives and positives are transported by a series of rollers through tanks within the processing machines that contain developer, fixer, wash and other solutions for the purpose of developing a latent image on the film.

During the development of the latent image on the film, the solutions contained in the various treatment tanks in the automatic processing machine become depleted in their chemical strength by means of the chemical reactions taking place with the films being processed, as well as by oxidation or other time dependent means of deterioration. This depletion of chemical strength and otherwise loss of efficacy that would result requires that the chemicals in the tanks of the processing machine be replenished with fresh chemicals. The treatment tanks in automatic processing machines are customarily replenished with relatively small, measured amounts of replenishment chemicals, generally in quantities of from about 80 to 120 cubic centimeters.

There are generally two methods used in the prior art for replenishing chemicals in the treatment tanks of the automatic processing machines. In the first method, a supplier who maintains or services the machines makes scheduled service calls for the purpose of keeping the storage containers associated with the processing machines properly filled with diluted chemical solutions. Concentrated chemicals are generally incompatible and cause unwanted precipitation and other reactions if mixed together in their concentrated state. Thus, the supplier must supply diluted chemical solutions for use in the day-to-day operation of the automatic processing machines.

This diluted, working solution must be stored in containers in the vicinity of the processing machine. The diluted, working solution itself is mixed at a remote site in batches generally of up to 1000 gallons or more at a time and filled into containers (typically five gallons each) to be transported to the site of the automatic processing machine. This process is extremely labor intensive and carries high transportation and delivery costs. In addition, since the mixing of the diluted, working solutions is often done by manual procedures, it is subject to human error and can be very inaccurate. The diluted, working solutions are commonly stored at the site of the automatic processing machines in containers that vary in size from five to eighty gallons or more. This causes undue hazards of on site storage of rather large quantities of chemicals and requires intensive regulatory compliance.

In the second general method of providing replenishment chemicals for the day-to-day operation of the automatic processing machine, the chemicals are supplied in concentrated form in prepackaged configurations that are to be mixed with a preset amount of fresh water to produce a diluted, working solution. This eliminates the storage of quantities of diluted, working solutions in excess of 5 to 10 gallons inasmuch as the prepackaged chemicals can be sized so as to produce such an amount. However, means must be provided for handling the concentrated chemicals and mixing the concentrated chemicals with a preset amount of fresh water. The prepackaged chemicals must be mixed with the proper amount of water in a mixer and the diluted solution is then stored in a suitable container.

There are many disadvantages associated with both of the general methods mentioned above. Both methods require mixing and storing a relatively large amounts of working solutions at least as compared to the small amount of such solution required to supply the cyclic demand of the processing machine. Anywhere from 10 to 80 or more gallons of working solution are generally stored at the site of the processing machine to supply a demand of approximately 100 cubic centimeters per cycle of the processing machine. On site storage of the relatively large amounts of chemicals presents problems of unnecessary hazards, require sizable storage space, present a problem with fumes and regulatory compliance procedures must be strictly followed.

Further, mixing of chemical materials as is required in both of the general methods as discussed above necessitates special mixing equipment such as tanks, mechanical mixers, high volume measuring equipment and relatively large storage space. The mixing becomes inaccurate because the measurements are done by hand. Thus it is subject to human error. It is also labor intensive and subject to relatively high costs. Off site mixing, as mentioned previously, requires storage and transportation of delivery containers and relatively large amounts of diluted chemicals. Transportation of the diluted chemicals is very costly as is the manual delivery and handling of the containers used to transport the diluted chemicals. Common to both of the general procedures discussed previously, the working solutions of the diluted chemicals are unstable and subject to decomposition with time. Oxidation and other modes of decomposition begin immediately following the mixing of the diluted chemicals. Working solutions are at their full strength and potency when used a short time after being mixed. The efficacy of the chemical components of the working solutions are greatly reduced with time following the mixing of the solutions.

Two prior art patents have been issued relating to methods and apparatus for replenishing chemical solutions in photographic processing machines. In U.S. Pat. No. 3,877,682 apparatus is disclosed for automatically measuring and mixing a predetermined quantity of two or more chemicals to form a working solution to be used in replenishing the chemical solutions in the treatment tanks of automatic photographic processors. The measuring and mixing are accomplished by using a single measuring chamber to measure all chemicals as well as water. The chamber drains into a mixing tank where the contents are mixed by means of a mixing pump. Following the mechanical mixing in the mixing tank, the mixed, diluted solutions are pumped into holding tanks. This method is impractical for several reasons. The method requires filling and emptying of the measuring chamber many times. For example, with chemical formulas for developer solutions in present use, the chamber would have to be filled 74 times to measure the water, 34 times for measurement of one component of the developer chemicals, and one time each for measurements of the second and third components of the developer chemicals. This is a total of 110 filling and dumping cycles of the measuring chamber to achieve a proper mix for the diluted, working solution. The amount of diluted, working solution produced is many times over the amount per cycle of working solution required for the photographic processing machine and requires storage of the excess, bulk supply of working solution.

The second patent, U.S. Pat. No. 3,822,723, discloses an apparatus for controlling make-up and addition of replenishment solution to a photographic processing machine. The device of this patent requires electronic input from sources reading percent of film exposure, replenishment rates, film size and time lapse. Based on this information, various chemical materials are fed directly into the various treatment tanks in the processing machine rather than being mixed together in a dilute, working solution that is added to the treatment tanks. This method is completely impractical with the customary processing machines which have no means of producing the electronic input relative to percent of film exposure, replenishment rates, film size and time lapse. The customary processing machines to which the present invention is directed require cyclic additions of predetermined, premixed amounts of diluted, working solution to the treatment tanks in the processing machine.

3. Objectives

A principal objective of the invention is to provide novel apparatus and procedures for automatically and accurately measuring and proportioning predetermined amounts of two or more concentrated chemical components and water. The chemical components and the water are mixed together in a static inline mixer that requires no mechanical mixer or other mixing mechanism. The chemicals and water are statically mixed to make one or more working solutions, and the working solutions are supplied directly to a processing machine upon demand from the processing machine in the relatively small amounts required by the processing machine. It is to be noted that although this invention is suited to supply chemical mixtures to automatic photographic film processing machines, it is also suited to many other types of chemical processes which require proportioning and mixing of chemical components.

A particular object of the present invention is to provide a relatively inexpensive system including apparatus and processes for mixing concentrated chemicals and water in small quantities to be delivered either directly to a photographic processing machine or through appropriate feed conduits to the processing machine upon demand from the processing machine.

An additional object of the present invention is to provide such a system and method in which concentrated chemicals are stored in relatively small storage containers within or adjacent to the processing machine, and as the processing machine calls for small quantities of diluted chemicals for replenishment of the working chemical solutions in the processing machine, the small quantities of diluted chemicals are produced in-situ by measuring or metering quantities of concentrated chemicals and water, mixing the chemicals and water immediately in static inline mixing devices and delivering the small quantities of diluted chemicals to the working chemical solutions in the processing machine either by directly adding the diluted chemicals to the treatment tanks containing the working chemical solutions or by feeding the diluted chemicals to the treatment tanks through feed conduits linking the inline static mixing devices and the treatment tanks of the processing machine.

BRIEF DESCRIPTION OF THE INVENTION

The above objectives are achieved in accordance with the present invention by providing a novel system and method in which upon demand from the processing machine for replenishment of one or more of the chemical working solutions contained in the processing machine, the system automatically determines that the concentrated chemical components are in place and available to be metered to an inline, static mixing device that forms part of the present system and method. At that time, one or more metering or proportioning devices measures or meters a predetermined portion of one or more concentrated chemicals and feeds the concentrated chemicals to a static mixing system comprising one or more static, inline mixing devices. Metered amounts of water are introduced into the static, inline mixing system where the water and the concentrated chemical components are mixed. The water and concentrated chemical components are mixed in the static inline mixing system by means of turbulent flow of the mixture through the inline mixing system. The concentrated chemicals are thus diluted to form a solution that can be added either directly to the working solutions in the processing machine or fed to the working solutions in the processing machine by appropriate conduits such as piping or tubing.

A significant advantage of the present invention is that replenishment chemicals are stored in the concentrated state in or adjacent to the processing machine. Storage space required for the concentrated chemicals is much less than required for storage of diluted chemicals. Service personnel need not make as numerous maintenance calls inasmuch as sufficient chemicals can be easily stored in a relatively small storage space to adequately supply the processing machine for an extended period of time. The concentrated chemicals are mixed to form small amounts of diluted replenishment solutions as such replenishment solutions are required by the processing machine. Storage space for diluted chemical solutions is eliminated. The aging of diluted chemical solutions while held in such storage is also eliminated. Small amounts of fresh, diluted chemical solutions are prepared in-situ as needed upon demand for such small amounts of solutions from the processing machine.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

In accordance with the present invention, novel apparatus and process are disclosed for (1) metering an amount of at least one concentrated liquid chemical solution, (2) metering an amount of water, (3) feeding the metered amounts of concentrated chemical solution and water to a static, inline mixing means and (4) delivering a relatively small amount of properly diluted working solution from the mixing means to a processing machine on demand for such relatively small amount of diluted working solution from the processing machine. The diluted working solution can either be delivered directly to the treatment tanks in the processing machine or through a conduit such as piping or tubing connecting the static mixing means and the treatment tanks of the processing machine.

Figure 1:
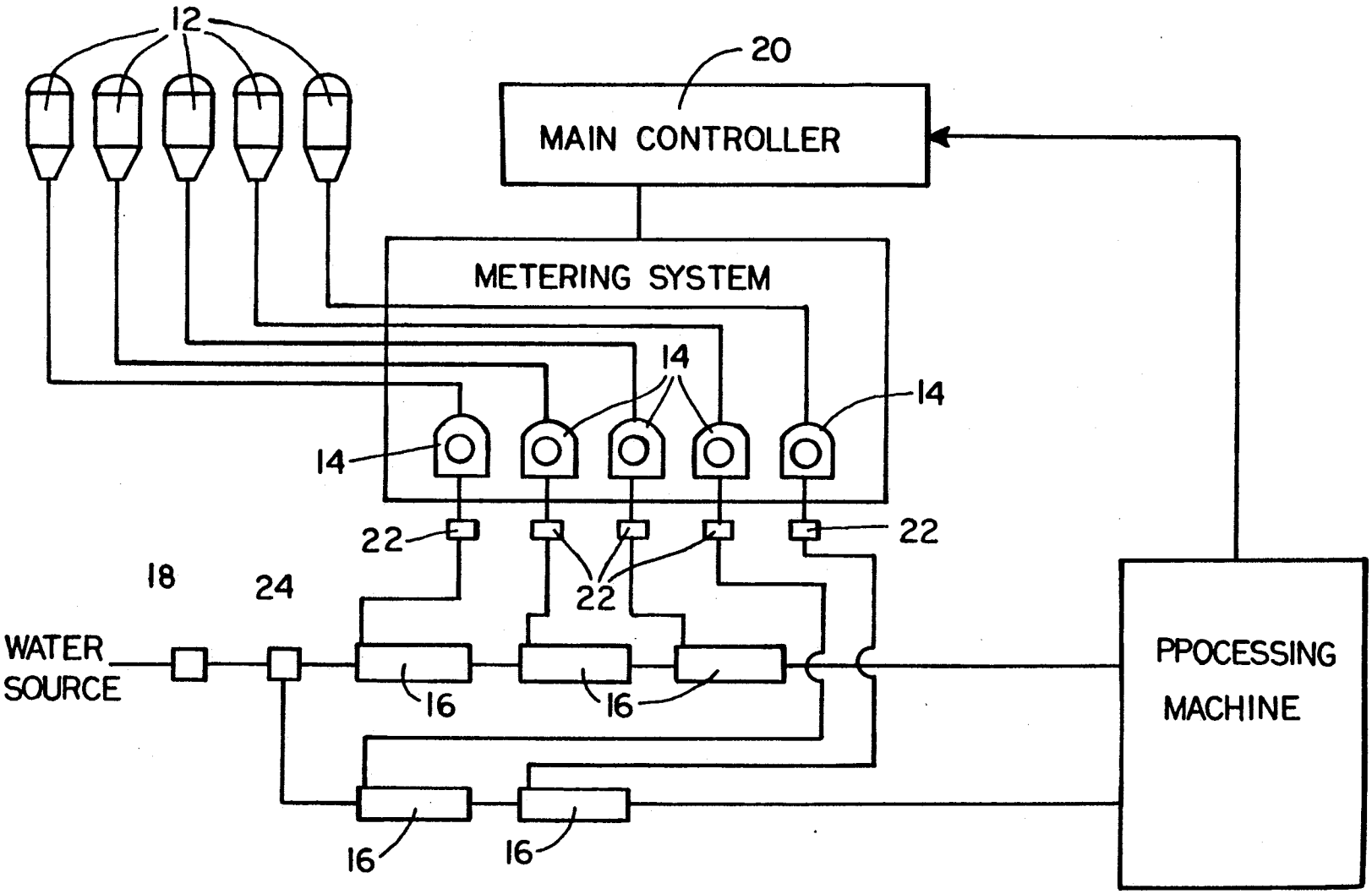
FIG. 1 is a schematic, block diagram of one preferred embodiment of apparatus of the present invention.
Figure 2:
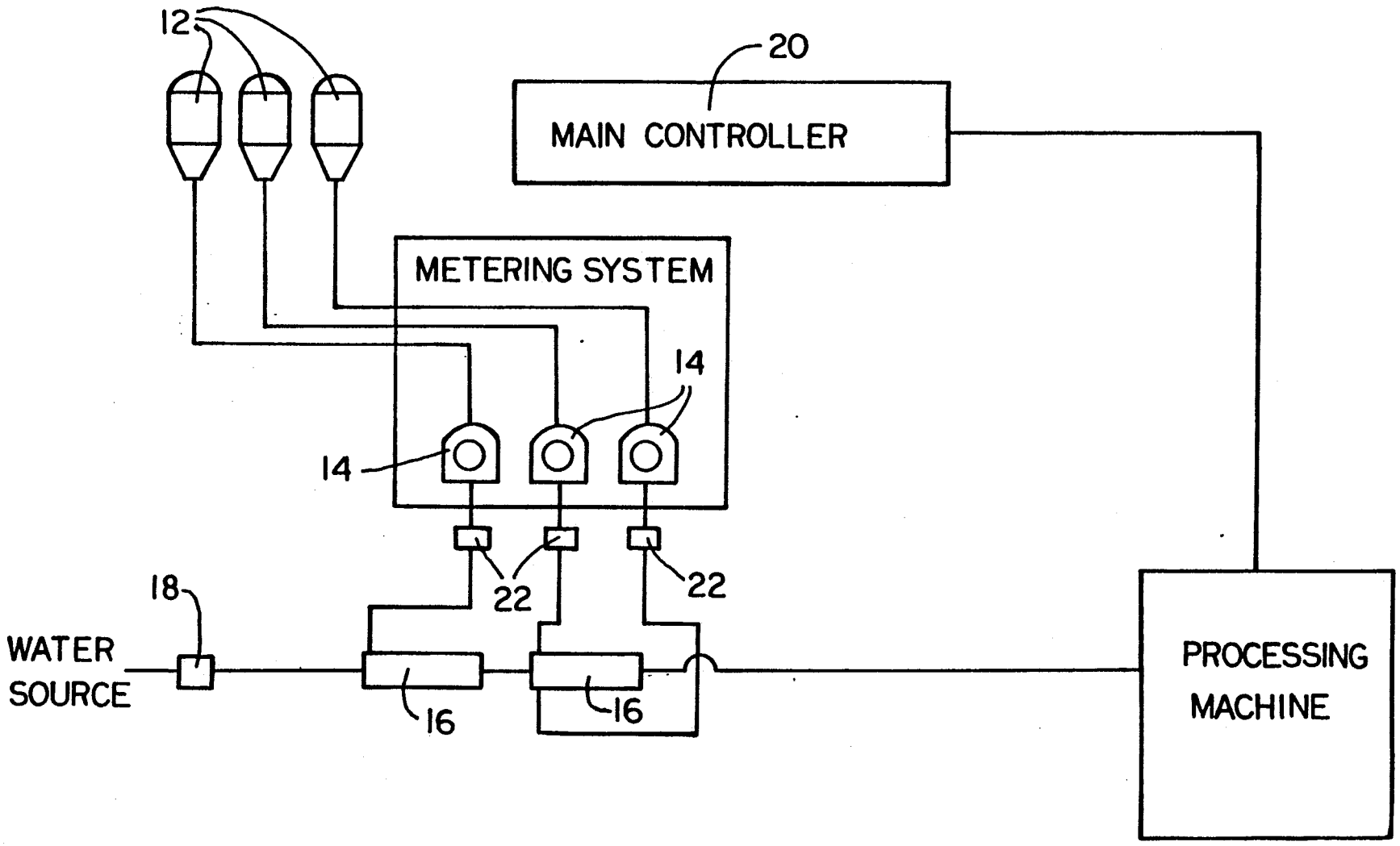
FIG. 2 is an schematic, block diagram similar to that of FIG. 1 but showing an alternative preferred embodiment of apparatus of the present invention.

As illustrated in the drawings, the apparatus comprises a storage container 12 for each concentrated liquid chemical solution that is to be used in preparing the working solution for the processing machine. Five storage containers are shown in FIG. 1 and three storage containers are shown in FIG. 2, but it is to be understood that more or less numbers of storage containers could be employed.

A metering device 14 is connected in flow communication with each storage container 12 for metering a controlled amount of concentrated liquid chemical solution from the storage container 12. Mixing means comprising at least one static mixing device 16 is connected in flow communication with each metering device 14 for accepting metered amounts of a concentrated liquid chemical solution from each such metering device. Each of the static mixing devices 14 is of the type that effects mixing of liquids introduced into the mixing device by turbulent flow of the liquids through the mixing device.

A water metering device 18 is connected in fluid flow communication with a source of water under pressure for metering a controlled amount of water from the source of water under pressure. The source of water is conveniently the culinary water supply of the city or water district in which the processing machine is located. Means are provided for further connecting the water metering device 18 in flow communication with the mixing means.

A supply conduit can be provided from the mixing means for delivering a mixed, diluted working solution from the mixing means directly to the processing machine. Alternatively, the mixing means can be coupled directly to the treatment tanks of the processing machine to deliver the working replenishment solution from the mixing means directly to the appropriate working tanks in the processing machine.

A control unit 20 is associated with the processing machine that upon demand from the processing machine controls the operation of the metering devices 14 and water metering devices 18 to deliver the proper amount of mixed, diluted working solution to the processing machine.

In the preferred embodiments shown in drawings, detectors 22 are further provided for detecting concentrated chemical solution at each of the metering devices 14. Then upon demand from the processing machine for replenishment solution, the control unit 20 activates the metering devices 14 and the water metering device 18 to provide the amount of working or replenishment solution demanded by the processing unit. If concentrated chemical solution is not detected at any of the metering devices, an alarm is given and operation of the apparatus is temporarily suspended until sufficient amounts of concentrated chemical solutions have been added to the apparatus. The metering devices 14 are advantageously positive displacement, proportioning devices, and metering is achieved by controlling the volumetric displacement of the positive displacement, proportioning devices.

As illustrated in FIG. 1, the mixing means comprises two separate mixing stations, with the first station having three static mixing devices 16 connected in series. Each static mixing device 16 in each of the mixing stations has an inlet and an outlet, and the static mixing devices 16 are connected in series such that the inlets of the second and subsequent static mixing devices 16 are in flow communication with a respective outlet of an immediate upstream static mixing device 16.

The means for connecting the water metering device 18 in flow communication with the mixing means comprises a conduit connecting the water metering device 18 to an inlet of a first static mixing device 16 in each of the mixing stations so that the metered amount of water flows initially through the first static mixing device 16 in each of the mixing stations and then serially through subsequent static mixing devices 16 in each mixing station.

Each metering device 14 is connected in flow communication with an inlet end of a separate, respective static mixing device such that the inlet of each static mixing device is connected to its own separate and distinct metering device. A metered amount of water flows through each static mixing device 16 in the first mixing station, i.e., the station having three static mixing devices 16. A respective concentrated liquid chemical solution is mixed therewith, and the solution coming from the outlet of the last static mixing device 16 in the first mixing station becomes the mixed, diluted working or replenishment solution that is delivered to the processing machine.

In the embodiment shown in FIG. 1, the first mixing station, i.e., the one comprising the three static mixing devices 16, has the three static mixing devices 16 connected in series with the others. A metered amount of water is delivered from the water metering device 18 to the first mixing device 16 in the series of three mixing devices comprising the first mixing station. This first mixing station is conveniently used to prepare a working replenishment solution for a three part developer solution to be used by the processing machine. Upon demand from the processing machine, as transferred by the control unit 20, each concentrated chemical part of the developer solution is metered by a metering device 14 and delivered to a respective mixing device 16 in the series of three such mixing devices, wherein the concentrated chemicals of the developer solution are diluted with water delivered from the water metering device 18. The diluted developer solution coming from the last mixing device 14 of the first mixing station is then fed directly to the treatment tank in the processing machine that contains the working developer solution.

The second mixing station, comprising the two static mixing devices 16, the two static mixing devices 16 are connected in series. Means, such as diversion valve 24, are provided so that metered amounts of water can be delivered from the water metering device 18 to the first mixing device 16 in the second mixing section. This second mixing station is conveniently used to prepare a working replenishment solution for a two part fixer to be used by the processing machine. Upon demand from the processing machine, as transferred by the control unit 20, each concentrated chemical part of the fixer solution is metered by a metering device 14 and delivered to a respective mixing device 16 of the second metering station wherein the concentrated chemicals of the fixer solution are diluted with water delivered from the water metering device 18. The diluted fixer solution coming from the second mixing station is then fed directly to the treatment tank in the processing machine that contains the working fixer solution.

When the concentrated chemicals that are to be mixed and diluted are incompatible if contacted together in the concentrated state, such as is the case with almost all developer solutions, it is advantageous to use the series connections of multiple mixing devices 16 as shown in FIG. 1. Alternatively, as shown in FIG. 2, a two stage mixing system can be provided comprising two mixing devices 16. In such embodiment, the chemical that is most subject to problems if contacted in the concentrated state with the other chemicals is introduced into the first mixing device 16 along with the metered water from the metering device 18. This diluted solution then flows directly to the second mixing device 16, and the remaining concentrated chemicals are introduced at the upstream end of the second mixing device 16 to mix with the diluted solution flowing through the second mixing device 16.

It should be recognized that if there is no problem with possible interaction of the separate concentrated chemicals, a single mixing device 16 could be employed. With a single mixing device, all the chemicals and the water are introduced at the upstream end of the mixing device 16 and mix together as they flow through the mixing device to form a dilute solution coming from the mixing device.

As will be evident from the above, the present invent ion encompasses a method of preparing a diluted working solution from concentrated liquid chemical solutions and delivering the diluted working solution to a processing machine. The method comprises in combination the steps of:

(a) providing a storage container for each concentrated liquid chemical solution that is to be used in preparing the working solution for the processing machine;

(b) upon demand from the processing machine for working solution, a metered amount of water is introduced into a static, inline mixing means;

(c) simultaneously with the introduction of the metered amount of water to the mixing means, a metered amount of each of the concentrated liquid chemical solutions from the storage containers is introduced into the mixing means such that as the water and concentrated liquid chemical solutions flow through the mixing means, the chemical solutions mix with the water and themselves and are diluted to a proper working solution by turbulent flow of the liquids through the mixing means; and (d) the working solution from the inline mixing means is fed to the processing machine.

The working solution from the inline mixing machine can be fed directly from the mixing means to the processing machine or, alternatively, the working solution can be delivered through a conduit from the inline mixing means to the processing machine.

Although preferred embodiments of the present invention have been illustrated and described, it is to be understood that the present disclosure is made by way of example and that various other embodiments are possible without departing from the subject matter coming within the scope of the following claims, which subject matter is regarded as the invention.

I claim:

1. Apparatus for (1) metering an amount of at least two concentrated liquid chemical solutions, (2) metering an amount of water, (3) feeding the metered amounts of concentrated chemical solutions and water to a static, inline mixing means and (4) delivering a properly diluted working solution from the mixing member to a processing machine on demand from the processing machine, said apparatus comprising in combination at least two storage containers, with a separate, distinct storage container being provided for each of the concentrated liquid chemical solutions;

at least two metering devices, with a separate, distinct metering device being connected to each storage container for metering a controlled amount of concentrated liquid chemical solution from the storage container;

mixing means comprising a number of static mixing devices equal to the number of concentrated liquid chemical solutions, with each static mixing device having an inlet and an outlet, wherein said static mixing devices are connected in series such that the inlets of the second and subsequent static mixing devices are connected to a respective outlet of an upstream static mixing device, and the inlet of each static mixing device is connected to a distinct, separate, respective metering device for accepting metered amounts of a concentrated liquid chemical solution from such respective metering device, and further wherein each said static mixing device is of the type that effects mixing of liquids introduced into the static mixing device by turbulent flow of the liquids through the static mixing device;

a water metering device connected in fluid flow communication with a source of water under pressure for metering a controlled amount of water from the source of water under pressure;

means for connecting the water metering device to an inlet of a first static mixing device in the series of static mixing devices so that the controlled amount of metered water from said water metering device flows initially through the first static mixing device and then serially through subsequent static mixing devices in the series of static mixing devices;

means for connecting an outlet of the last static mixing device in the series of static mixing devices to the processing machine for delivering a mixed, diluted working solution from said last static mixing device directly to the processing machine; and a control unit that controls the operation of the metering devices and water metering device to deliver the proper amount of mixed, diluted working solution from said last static mixing device to the processing machine.

2. Apparatus in accordance with claim 1 further including detectors for detecting concentrated chemical solution at each of the metering devices such that upon demand from the processing machine for working solution, the control unit activates said metering devices and said water metering device to provide the amount of working solution demanded by the processing unit, but if concentrated chemical solution is not detected at any of the metering devices, an alarm is given and operation of the apparatus is temporarily suspended until sufficient amounts of concentrated chemical solutions have been added to the apparatus.

3. Apparatus in accordance with claim 1 wherein said metering devices are positive displacement, proportioning devices and metering is achieved by controlling the volumetric displacement of the positive displacement, proportioning devices.

4. Apparatus for (1) metering an amount of at least three concentrated liquid chemical solutions, (2) metering an amount of water, (3) feeding the metered amounts of concentrated chemical solutions and water to a static, inline mixing means and (4) delivering a properly diluted working solution from the mixing member to a processing machine on demand from the processing machine, said apparatus comprising in combination;

at least three storage containers, with a separate, distinct storage container being provided for each of the concentrated liquid chemical solutions;

at least three metering devices, with a separate, distinct metering device being connected to each storage container for metering a controlled amount of concentrated liquid chemical solution from the storage container;

mixing means comprising first and second static mixing devices, wherein each static mixing device has an inlet and an outlet and the static mixing devices are connected in series such that the inlet of the second static mixing device is connected to the outlet of the first static mixing device, with each static mixing device being of the type that effects mixing of liquids introduced into the static mixing device by turbulent flow of the liquids through the static mixing device;

a water metering device connected to a source of water under pressure for metering a controlled amount of water from the source of water under pressure;

means for connecting the water metering device to the inlet of the first static mixing device;

means for connecting the inlet of the first static mixing device to the metering device that is connected to a first storage container;

means for connecting the inlet end of the second static mixing device to each of the metering devices connected to the remaining storage containers;

means for connecting the outlet of the second static mixing device to the processing machine; and a control unit that controls the operation of the metering devices and water metering device to deliver the proper amount of mixed, diluted working solution from said second static mixing device to the processing machine, whereby as the metered amount of water flows through the first static mixing device, a concentrated liquid chemical solution from said first storage container is mixed therewith, and as the metered amount of water flows through the second static mixing device, concentrated liquid chemical solutions from the remaining storage containers are mixed therewith, and the solution coming from the outlet of the second static mixing device is delivered from said second static mixing device to the processing machine.

5. A method of preparing a diluted working solution from at least two concentrated liquid chemical solutions and delivering the diluted working solution to a processing machine, said method comprising providing separate, distinct storage containers, at least one storage container for each of the concentrated liquid chemical solutions;

upon demand from the processing machine for working solution, a metered amount of water is introduced into a static, inline mixing means that comprises a number of static mixing devices equal to the number of concentrated liquid chemical solutions, with each static mixing device having an inlet and an outlet and with the static mixing devices being connected in series such that the inlets of the second and subsequent static mixing devices are connected to a respective outlet of an upstream static mixing device, and further with the metered amount of water being introduced into an inlet of a first static mixing device in the series of static mixing devices so that the metered amount of water flows initially through the first static mixing device and then serially through subsequent static mixing devices in the series of static mixing devices;

while the metered amount of water is being introduced into the inlet of the first static mixing device, metered amounts of each of the concentrated liquid chemical solutions from said storage containers are introduced into inlets of respective static mixing devices such that the inlet of each static mixing device receives only one of the concentrated liquid chemical solutions, with the other concentrated chemical solutions being introduced into the inlet of the other respective static mixing devices, whereby as the metered amount of water flows through each static mixing device in the series of static mixing devices, a respective, concentrated liquid chemical solution is mixed therewith, and the working solution from the outlet of the last static mixing device consists of a diluted solution formed from the mixing of the concentrated liquid chemicals and the water in the static mixing devices; and feeding the working solution from the last static mixing device in the inline mixing means to the processing machine.

6. A method in accordance with claim 5 wherein the working solution is fed directly from the last static mixing device to the processing machine.

7. A method in accordance with claim 5 wherein the working solution is delivered through a conduit from the last static mixing device to the processing machine.

8. A method of preparing a diluted working solution from at least three concentrated liquid chemical solutions and delivering the working solution to a processing machine, said method comprising providing separate, distinct storage containers, at least one storage container for each of the concentrated liquid chemical solutions;

upon demand from the processing machine for working solution, a metered amount of water is introduced into a static, inline mixing means that comprises first and second static mixing devices, with each static mixing device having an inlet and an outlet and with the static mixing devices being connected in series such that the inlet of the second static mixing device is connected to the outlet of the first static mixing device and further with the metered amount of water being introduced into the first inlet of the first static mixing device so that the metered amount of water flows initially through the first static mixing device and then through the second static mixing device; and while the metered amount of water is being introduced into the inlet of the first static metering device, a metered amount of one of the concentrated liquid chemical solutions from a respective storage container is also introduced into the inlet of the first static mixing device, and metered amounts of the remaining concentrated liquid chemical solutions from remaining respective storage containers are introduced into the inlet of the second static mixing device, whereby as the metered amount of water flows through the first static mixing device, said one of the concentrated liquid chemical solutions is mixed therewith, and as the metered amount of water flows through the second static mixing device, all remaining concentrated liquid chemical solutions are mixed therewith, and the solution from the outlet of the second static mixing device consists of a diluted working solution formed from the mixing of the concentrated liquid chemicals and water in the static mixing devices; and feeding the working solution from the second static mixing device to the processing machine.

* * * * *